US009513582B2

(12) United States Patent
Wu et al.

(10) Patent No.: US 9,513,582 B2
(45) Date of Patent: Dec. 6, 2016

(54) TRANSFER ASSIST MEMBERS

(71) Applicant: Xerox Corporation, Norwalk, CT (US)

(72) Inventors: Jin Wu, Pittsford, NY (US); Jonathan H. Herko, Walworth, NY (US); Lanhui Zhang, Webster, NY (US); Lin Ma, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 294 days.

(21) Appl. No.: 14/483,621

(22) Filed: Sep. 11, 2014

(65) Prior Publication Data

US 2016/0077471 A1 Mar. 17, 2016

(51) Int. Cl.
*G03G 15/16* (2006.01)

(52) U.S. Cl.
CPC ..... *G03G 15/1685* (2013.01)

(58) Field of Classification Search
CPC ..... G03G 15/1685
See application file for complete search history.

(56) References Cited

U.S. PATENT DOCUMENTS

| | | | | |
|---|---|---|---|---|
| 5,753,396 | A * | 5/1998 | Nakamura | G03G 5/04 430/100 |
| 2003/0039488 | A1* | 2/2003 | Fayette | G03G 15/165 399/316 |
| 2003/0087175 | A1* | 5/2003 | Simpson | G03G 15/162 430/125.32 |
| 2004/0142269 | A1* | 7/2004 | Kotsugai | G03G 9/1135 430/111.35 |
| 2009/0080951 | A1* | 3/2009 | Montfort | G03G 15/16 399/316 |

* cited by examiner

*Primary Examiner* — Robert Jones, Jr.
(74) *Attorney, Agent, or Firm* — Eugene O. Palazzo

(57) ABSTRACT

A transfer assist member comprising a plurality of layers, at least one of the layers being a check film layer comprised of a crosslinked alkoxyalkylated polyamide.

23 Claims, 4 Drawing Sheets

TRANSFER ASSIST MEMBERS

This disclosure is generally directed to transfer assist members comprised of a plurality of layers, one of which layers is a check film layer comprised of a crosslinked alkoxyalkylated polyamide.

BACKGROUND

In the process of xerography, a light image of an original to be copied is typically recorded in the form of a latent electrostatic image upon a photosensitive or a photoconductive member with subsequent visible rendering of the latent image by the application of a particulate thermoplastic material, commonly referred to as toner. The visual toner image can be either fixed directly upon the photosensitive member or the photoconductor member, or transferred from either member to another support, such as a sheet of plain paper, with subsequent affixing by, for example, the application of heat and pressure of the image thereto.

To affix or fuse toner material onto a support member like paper by heat and pressure, it is usually necessary to elevate the temperature of the toner and simultaneously apply pressure sufficient to cause the constituents of the toner to become tacky and coalesce. In both the xerographic as well as the electrographic recording arts, the use of thermal energy for fixing toner images onto a support member is known.

One approach to the heat and pressure fusing of toner images onto a support has been to pass the support with the toner images thereon between a pair of pressure engaged roller members, at least one of which is internally heated. For example, the support may pass between a fuser roller and a pressure roller. During operation of a fusing system of this type, the support member to which the toner images are electrostatically adhered is moved through the nip formed between the rollers with the toner image contacting the fuser roll thereby to effect heating of the toner images within the nip.

In general, transfer of developed toner images in electrostatographic applications has been accomplished via electrostatic induction using a corona generating device, wherein the image support substrate is placed in direct contact with the developed toner image on the photoconductive surface while the reverse side of the image support substrate is exposed to a corona discharge. This corona discharge generates ions having a polarity opposite that of the toner particles, thereby electrostatically attracting and transferring the toner particles from the photoreceptive member to the image support substrate.

The process of transferring charged toner particles from an image bearing member marking device, such as a photoconductor, to an image support substrate like a sheet of paper involves overcoming cohesive forces holding the toner particles to the image bearing member. The interface between the photoconductor surface and image support substrate may not in many instances be optimal or may be inconsistent, thus, in the transfer process when spaces or gaps exist between the developed image and the image support substrate the quality of the image may not be acceptable. One aspect of the transfer process is focused on the application and maintenance of high intensity electrostatic fields in the transfer region for overcoming the cohesive forces acting on the toner particles as they rest on the photoconductive member. Careful and somewhat costly control of the electrostatic fields and other forces present can be required to induce the physical detachment and transfer of the charged toner particles without scattering or smearing of the developer material.

More specifically, in the xerographic electrostatic transfer of the toner powder image to the copy sheet, it is necessary for the copy sheet to be in uniform intimate contact with the toner powder image developed on the photoconductive surface. In particular, non-flat or uneven image support substrates, such as copy sheets that have been mishandled, left exposed to the environment or previously passed through a fixing operation, such as heat and/or pressure fusing, tend to promulgate imperfect contact with the surface of the photoconductor. Further, in the event the copy sheet is wrinkled, the sheet will usually not be in intimate contact with the photoconductive surface and spaces, or air gaps will materialize between the developed image on the photoconductive surface and the copy sheet. When spaces or gaps exist between the developed image and the copy substrate, there is a tendency for toner not to transfer across these gaps causing variable transfer efficiencies, and where areas of low or no transfer results in a phenomenon known as image transfer deletion.

Image transfer deletion is undesirable in that portions of the developed toner image may not be accurately reproduced on paper in that the area of the cleaning blade or transfer assist member that contacts the photoreceptor and the cleaning blade will in most instances pick up residual dirt and toner from the photoreceptor surface. Therefore, in the next printing cycle the residual dirt present on the cleaning member or transfer assist member is transferred to the back side of the paper resulting in unacceptable print quality defects. Mechanical devices, such as rollers, have been used in attempts to force the paper or other image support substrates into substantially uniform contact with the paper or image bearing surface.

With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and redeveloping, all followed by transfer to paper, can be completed in a single revolution of the photoreceptor in so-called single pass machines, while multipass architectures form each color separation with a single charge, image and develop, with separate transfer operations for each color.

In single pass color machines, it is desirable to cause as little disturbance to the photoreceptor as possible so that motion errors are not propagated along the belt to cause image quality and color separation registration problems. One area that has potential to cause such a disturbance is when a sheet is released from the guide after having been brought into contact with the photoreceptor for transfer of the developed image thereto. This disturbance, which is often referred to as trail edge flip, can cause image defects on the sheet due to the motion of the sheet during transfer caused by energy released due to the bending forces of the sheet. Particularly in copying and printing machines which handle a large range of paper weights and sizes, it is difficult to have a sheet guide which can properly position any weight and size sheet while not causing the sheet to oscillate after having come in contact with the photoreceptor.

There is a need for members and processes that substantially avoid or minimize the disadvantages illustrated herein.

Also, there is a need for transfer assist members that are wear resistant and that can be used for extended time periods without being replaced.

Further, there is a need for check films that have a flat orientation, possess improved wear and rub resistance, and have desirable resistance characteristics.

Yet further, there is a need for transfer assist members that are environmentally acceptable, and where toxic solvents, such as methylene chloride, are avoided, and which members can be economically and efficiently manufactured, and where the amount of energy consumed is reduced.

There is also a need for toner developed image transfer assist members that permit the continuous contact between a photoconductor and the substrate to which the developed toner image is to be transferred, and an apparatus for enhancing contact between a copy sheet and a developed image positioned on a photoconductive member.

Yet another need resides in providing xerographic printing systems, inclusive of multi-color generating systems, where there is selected a transfer assist member that maintains sufficient constant pressure on the substrate to which a developed image is to be transferred, and where there is substantially eliminated air gaps between the substrate and the photoconductor primarily because the presence of air gaps can cause air breakdown in the transfer field.

Further, there is a need for transfer assist members that enable suitable and full contact of the developed toner image present on a photoconductor, and a substrate to which the developed image is to be transferred.

Additionally, there is a need for transfer assist members that contain durable formaldehyde free compositions, and which members can be economically and efficiently manufactured, and where the amount of energy consumed is reduced.

Yet additionally, there is a need for a multilayered transfer assist member that includes as one layer a check film on the side exposed to a dicorotron/corona, and which member possesses excellent and preselected specific resistance characteristics, and which check film is wear and rub resistant.

Also, there is a need for transfer assist members where the check film layer thereof can be generated by economical extrusion processing.

Further, there is a need for transfer assist members with a combination of excellent durability, that exert sufficient constant pressure on a substrate sheet, and permit the substrate to fully contact the toner developed image on a photoconductor, which members provide mechanical pressure, about 20 percent of its function and electrostatic pressure/tailoring about 80 percent of its function, and where complete transfer to a sheet of a toner developed image from a photoconductor results, such as for example, about 90 to about 100 percent, from about 90 to about 98 percent, from about 95 to about 99 percent, and in embodiments about 100 percent of the toner developed image is transferred to the sheet or a substrate, and wherein blurred final images are minimized or avoided.

Moreover, there is a need for composite transfer assist blades that overcome or minimize the problems associated with a single component blade as a single component blade in order to be flexible enough to prevent image damage does not provide enough contact force to the back of the sheet to enable complete image transfer giving rise to transfer deletions and color shift.

Yet, there is another need for transfer assist members that include check films, and which members are useful in electrophotographic imaging apparatuses, including digital printing where the latent image is produced by a modulated laser beam, or ionographic printing, and where charges are deposited on a charge retentive surface in response to electronically generated or stored images.

Additionally, there is a need for a xerographic system containing an improved transfer assist blade (TAB) which is used in conjunction with a corona device to perform transfer, such as by effectively moving toner from a photoconductor media, and where the TAB functions to provide mechanical pressure and electrostatic pressure/tailoring with the electrostatic pressure/tailoring being achieved by utilizing a check film comprising the disclosed crosslinked layer mixture on a supporting substrate.

These and other needs are achievable in embodiments with the transfer assist members and components thereof disclosed herein.

SUMMARY

Disclosed is a transfer assist member comprising a plurality of layers, one of the layers being a check film layer comprised of a crosslinked alkoxyalkylated polyamide.

Also disclosed is a composite toner transfer assist blade comprising a plurality of bonded layers inclusive of a bonded check film layer comprised of a crosslinked layer mixture of alkoxyalkylated polyamide contained on a polymer layer substrate of a polyalkylene terephthalate, a polyester, or mixtures thereof; and further including in the mixture at least one conductive component, at least one catalyst, at least one polysiloxane polymer, and a polyvinylbutyral.

Further disclosed is a xerographic process for providing substantially uniform contact between a copy substrate and a toner developed image located on an imaging member, comprising providing the contact by using a toner transfer flexible assist blade that comprises a plurality of adhesive bonded layers, wherein the flexible transfer assist blade is adapted to move from a non-operative position spaced from the imaging member to an operative position in contact with the copy substrate on the imaging member, applying pressure against the copy substrate in a direction toward the imaging member, and wherein the plurality of layers comprises at least one of a check film layer comprised of a mixture of a crosslinked alkoxyalkylated polyamide, a conductive component, an acid catalyst, an optional leveling agent, and a polyvinyl butyral resin, and wherein the crosslinked value is from about 75 to about 100 percent, and which mixture layer is present on a polymer substrate of a polyalkylene terephthalate, a polyester, or mixtures thereof.

FIGURES

The following Figures are provided to further illustrate the transfer assist members and check films disclosed herein.

EMBODIMENTS

The disclosed transfer assist members comprise an optional supporting substrate, such as a polymer and a crosslinked overcoat layer comprised of an alkoxyalkylated polyamide, and where the members or single member apply pressure against a copy substrate like a sheet of paper to create uniform contact between the copy substrate and a developed image formed on an imaging member like a photoconductor. The transfer assist member, such as for example a blade, presses the copy sheet into contact with at least the developed image on the photoconductive surface to substantially eliminate any spaces or gaps between the copy sheet and the developed image during transfer of the developed image from the photoconductive surface to the copy substrate.

Figure 1:
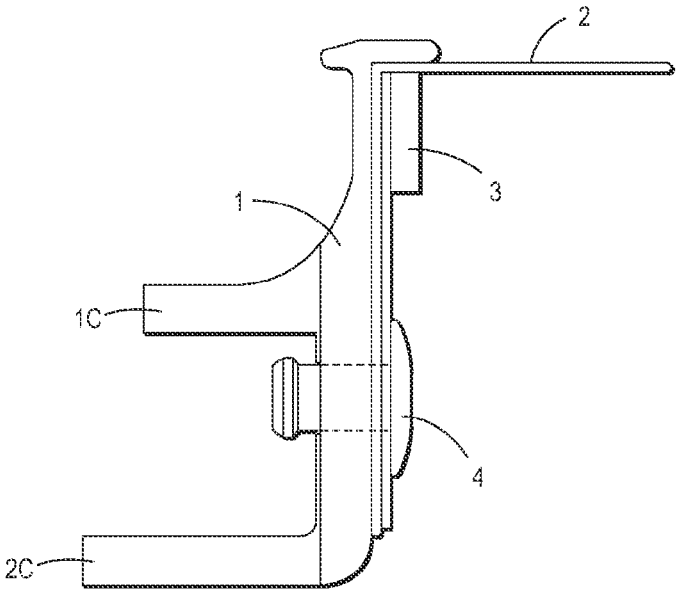
FIG. 1 and FIG. 1A illustrate exemplary side views of the transfer assist member of the present disclosure.

FIG. 1 illustrates a side view of the transfer assist member assembly of the present disclosure. More specifically, illustrated in FIG. 1 is an aluminum component 1 to secure the member, such as a blade (illustrated herein by the transfer assist member petal assembly 2), and which component 1 is attached to the transfer assist member petal assembly 2, and where the petal assembly 2 is comprised of the multi-layer blade member as shown in FIG. 3, and where the numeral or designation 3 (shown in FIGS. 1, 1A and 2) represents a stainless steel clamp, and the designation 4 (shown in FIGS. 1, 1A, and 2) represents an aluminum rivet, whereby the clamp 3 and rivet 4 retain in position the petal assembly 2 between clamp 3 and the aluminum component 1, and where 1C and 2C represent spaced-apart integral arms of aluminum component 1.

Figure 1A:
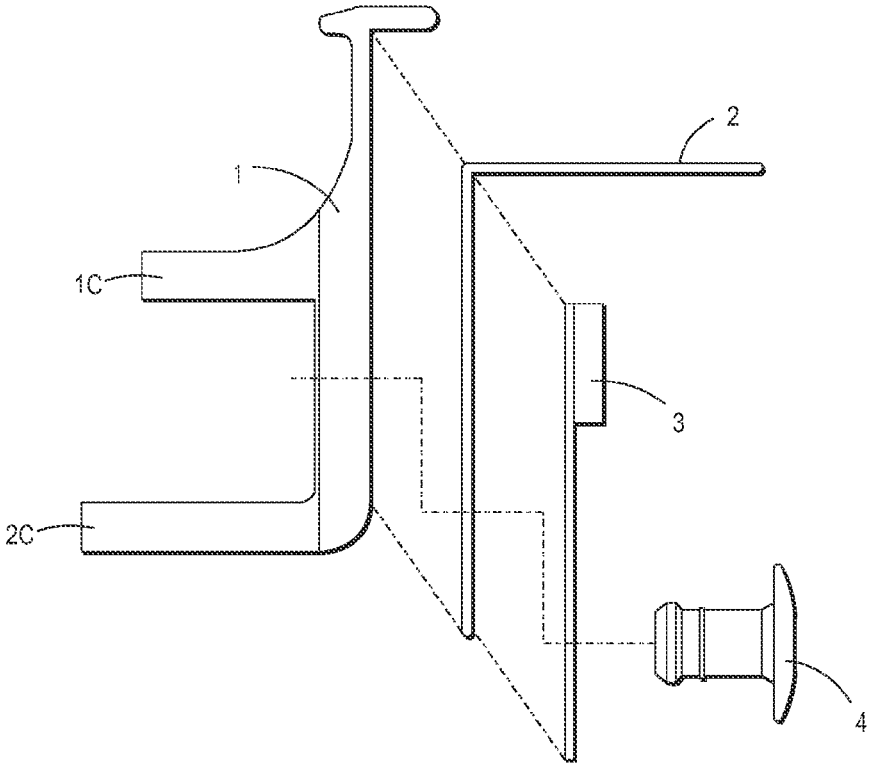

The corresponding FIG. 1A illustrates the disassembled elements or form of the transfer assist members of the present disclosure where the designations 1, 2, 3, 4, 1C and 2C for this FIG. 1A are the same as those designations as shown in FIG. 1.

Figure 2:
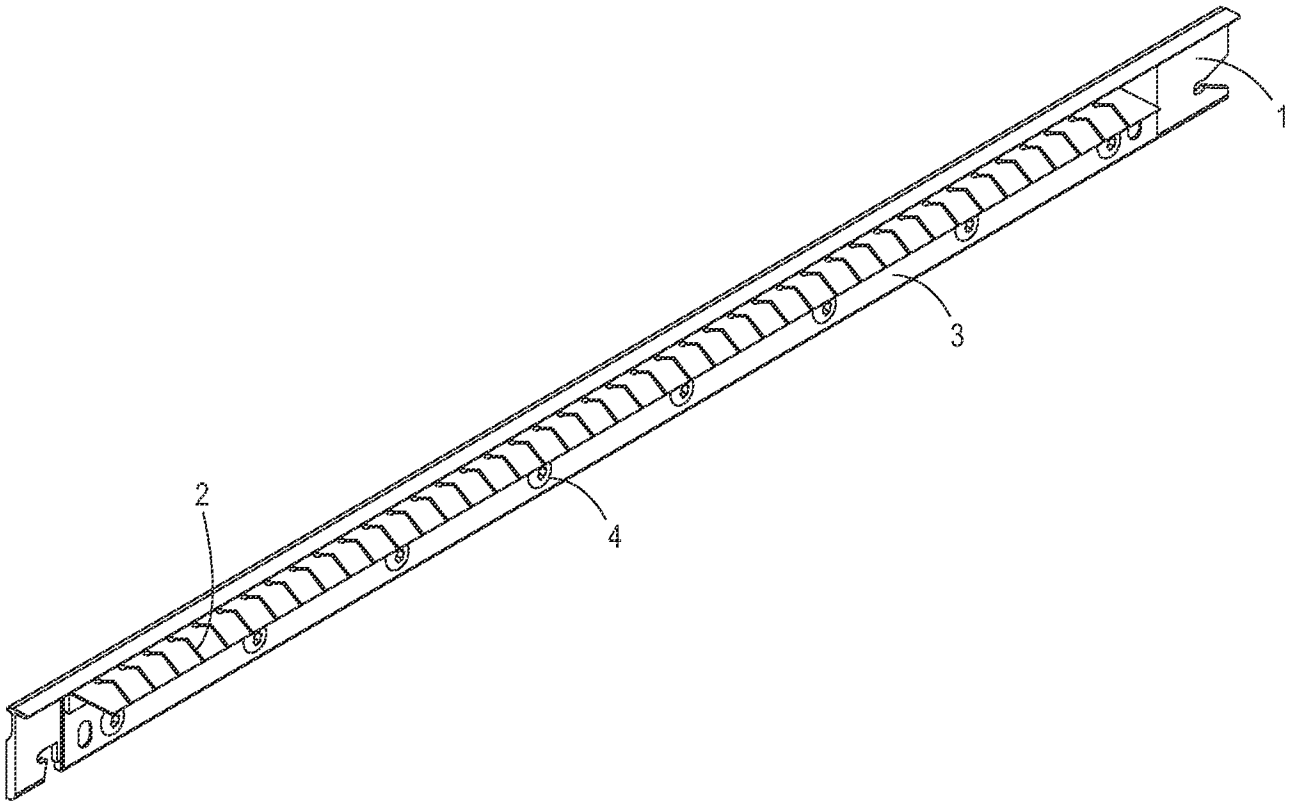
FIG. 2 illustrates an exemplary view of the transfer assist member assembly of the present disclosure.
Figure 3:
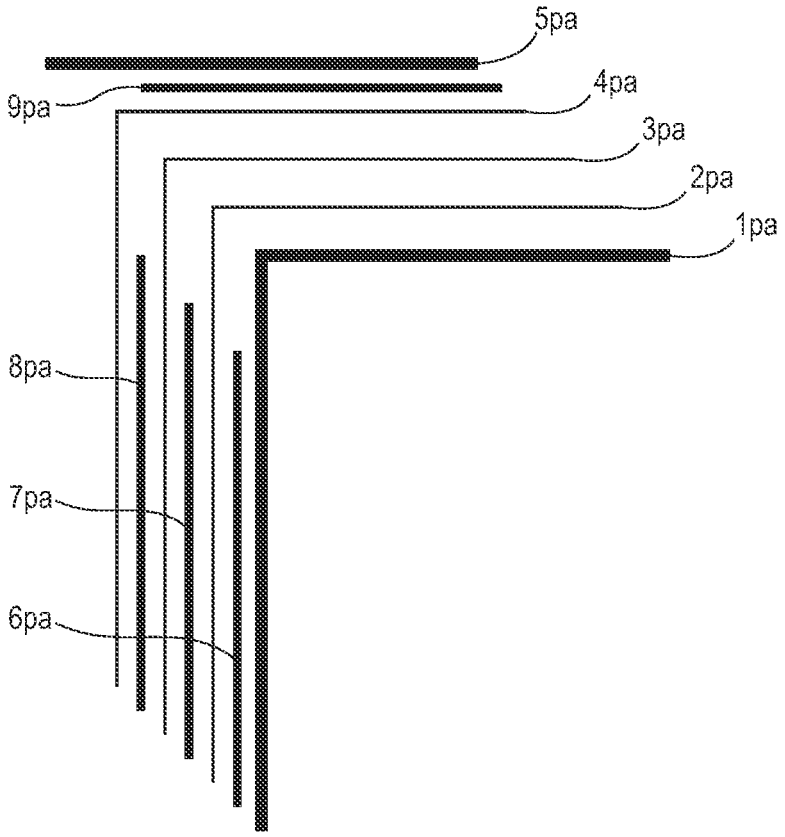
FIG. 3 illustrates an exemplary view of the transfer assist member petal of the present disclosure.

FIG. 2 illustrates another view of the transfer assist member assembly of the present disclosure, and where the designations 1, 2, 3, and 4 for this Figure are the same as the designations as presented in FIG. 1, that is there is shown an aluminum component 1 to secure the member, such as a blade, which blade is generated, for example, by extrusion processes, to the transfer assist member petal assembly 2, and where the petal assembly 2 comprises the multi-layer blade member as shown in FIG. 3, and where numeral or designation 3 represents a stainless steel clamp, and designation 4 represents an aluminum rivet, and which clamp and rivet retain in position the petal assembly 2, between designations 3 and 1.

FIG. 3 illustrates the components and compositions of the transfer assist member petal assembly of the present disclosure. More specifically, shown in FIG. 3 is an embodiment of the transfer assist member petal assembly 2 of the present disclosure. Specifically, the transfer assist member petal assembly 2 (shown in FIGS. 1, 1A and 2) comprises the check film layer 1*pa*, which itself comprises a polymer substrate and an alkoxyalkylated polyamide crosslinked polymer or resin, and wherein in embodiments layer 1*pa* is comprised of two inseparable layers. The transfer assist member petal assembly 2 further includes an optional top wear resistant layer 5*pa*, such as polyolefins as illustrated herein, and which member may also include optional adhesive layers 6*pa*, 7*pa*, 8*pa* and 9*pa* between the respective pairs of layers 1*pa* and 2*pa*, 2*pa* and 3*pa*, 3*pa* and 4*pa*, 4*pa* and 5*pa*, as shown in FIG. 3.

The layers 2*pa*, 3*pa*, and 4*pa* are comprised of suitable polymers, such as for example, MYLAR®, MELINEX®, TEIJIN®, TETORON®, and TEONEX®, considered to be biaxially oriented polyester films which are commercially available in a variety of finishes and thicknesses, and more specifically, polyethylene terephthalates. These and other similar polymers that can be selected are available from E.I. DuPont Company or SKC Incorporated. These layers are each of effective thicknesses of, for example, from about 1 to about 20 mils, from about 1 to about 12 mils, from about 5 to about 7 mils, and more specifically, about 5 mils where one mil is equal to 0.001 of an inch (0.0254 mm). The primary functions of layers 2*pa*, 3*pa* and 4*pa* are for providing for the mechanical integrity of the transfer assist member petal and the disclosed transfer assist members.

Figure 4:
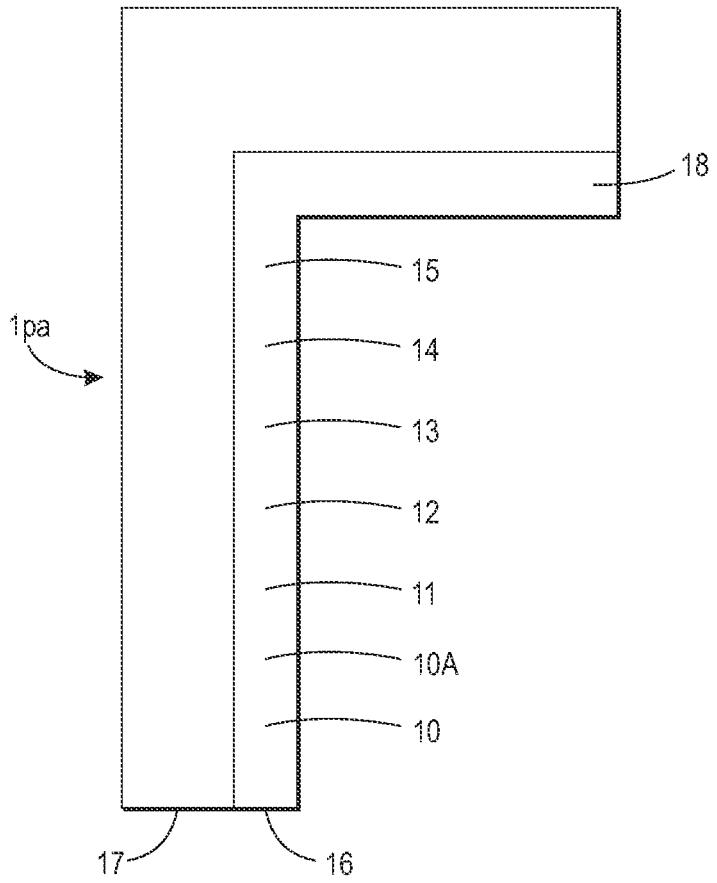
FIG. 4 illustrates an exemplary view of the check film or partially conductive film of the present disclosure.

FIG. 4 illustrates the components and compositions of the transfer assist member check film components of the present disclosure. More specifically, shown in FIG. 4 is an embodiment of the check film 1*pa* comprised of supporting substrate layer 17, and a layer 16 comprised of a crosslinked mixture of an alkoxyalkylated polyamide 10, an optional second resin of, for example, polyvinyl butyral 10A, catalysts 11, optional conductive components or fillers 12, optional silicas 13, optional fluoropolymer particles 14, optional plasticizers 15, and optional leveling agents 18, and wherein in embodiments layers 16 and 17 are inseparable layers.

Therefore, in an embodiment of the present disclosure there is provided a transfer assist member, such as a blade, with for example, a partially conductive crosslinked mixture with, for example, a resistance of from about $1\times10^5$ ohm to about $1\times10^{10}$ ohm, a resistance of from about $1\times10^7$ to about $1\times10^9$ ohm, a resistance of from about $1\times10^6$ to about $1\times10^9$ ohm, a resistance of from about $1\times10^8$ to about $9\times10^8$ ohm, and more specifically a resistance of $5.1\times10^8$ ohm as measured with a Resistance Meter, and comprised of a crosslinked mixture of an alkoxyalkylated polyamide overcoat contained on an optional supporting substrate, and where the crosslinked mixture can further include a second resin, at least one conductive component, such as carbon black, metal oxides or mixed metal oxides, conducting polymers such as polyaniline, polythiophene or polypyrrole, a catalyst, a silicone or fluoro leveling agent, a plasticizer, a silica and a fluoropolymer, and where the transfer assist member is, for example, from 1 to about 10 layers, from about 2 to about 10 layers, from about 2 to about 8 layers, from 2 to about 5 layers, from about 3 to about 7 layers, or from about 3 to about 5 layers.

Supporting Substrates

Various supporting substrates, such as substrate layer 17, can be selected for the generated transfer assist members disclosed herein, examples of which are polycarbonates, polyesters, polysulfones, polyamides, polyimides, polyamideimides, polyetherimides, polyolefins, polystyrenes, polyvinyl halides, polyvinylidene halides, polyphenyl sulfides, polyphenyl oxides, polyaryl ethers, polyether ether ketones, polyethylene terephthalate polymers (PET), polyethylene naphthalates, mixtures thereof, and the like.

Suitable polyester substrate examples include MYLAR®, MELINEX®, TEIJIN®, TETORON®, and TEONEX®, considered to be biaxially oriented polyester films, which are commercially available in a variety of finishes and thicknesses. These and other similar polymers are available from E.I. DuPont Company or SKC Incorporated.

Polycarbonate polymer supporting substrate examples that can be selected include poly(4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, the polymer supporting substrates are comprised of bisphenol-A-polycarbonate resins, commercially available as MAKROLON® or FPC® with, for example, a weight average molecular weight of from about 50,000 to about 500,000, or from about 225,000 to about 425,000.

Polysulfone supporting substrate examples selected for the disclosed members include polyphenylsulfones such as RADEL® R-5000NT and 5900NT, polysulfones such as UDEL® P-1700, P-3500, and polyethersulfones such as RADEL® A-200A, AG-210NT, AG-320NT, VERADEL® 3000P, 3100P, 3200P, all available or obtainable from Solvay Advanced Polymers, LLC, Alpharetta, Ga.

Polyphenylene sulfide supporting substrate polymers that can be selected for the disclosed members include RYTON®, a polyphenylene sulfide, available from Chevron Phillips as a crosslinked polymer; FORTRON®, a polyphenylene sulfide available from Ticona Incorporated as a linear polymer, and SULFAR®, a polyphenylene sulfide available from Testori Incorporated.

Supporting substrate polyamide polymers that can be selected for the disclosed transfer assist members include aliphatic polyamides, such as Nylon 6 and Nylon 66 available from DuPont, semi-aromatic polyamides, or polyphthalamides such as TROGAMID® 6T available from Evonik Industries, and aromatic polyamides, or aramides, such as KEVLAR® and NOMEX® available from DuPont, and TEIJINCONEX®, TWARON® and TECHNORA® available from Teijin Incorporated.

Examples of polyether ether ketone polymers that can be selected for the disclosed members supporting substrates include VICTREX® PEEK 90G, 150G, 450G, 150FC30, 450FC30, 150FW30, 450FE20, WG101, WG102, ESD101, all available from VICTREX Manufacturing Limited.

Polyamideimide examples that can be selected for the disclosed members supporting substrates include TORLON® Al-10 ($T_g$=272° C.), commercially available from Solvay Advanced Polymers, LLC, Alpharetta, Ga.

Examples of polyetherimide polymers that can be selected as supporting substrates for the disclosed members, where $T_g$ represents the glass transition temperature as determined by a number of known methods, and more specifically by Differential Scanning calorimetry (DSC), include ULTEM® 1000 ($T_g$=210° C.), 1010 ($T_g$=217° C.), 1100 ($T_g$=217° C.), 1285, 2100 ($T_g$=217° C.), 2200 ($T_g$=217° C.), 2210 ($T_g$=217° C.), 2212 ($T_g$=217° C.), 2300 ($T_g$=217° C.), 2310 ($T_g$=217° C.), 2312 ($T_g$=217° C.), 2313 ($T_g$=217° C.), 2400 ($T_g$=217° C.), 2410 ($T_g$=217° C.), 3451 ($T_g$=217° C.), 3452 ($T_g$=217° C.), 4000 ($T_g$=217° C.), 4001 ($T_g$=217° C.), 4002 ($T_g$=217° C.), 4211 ($T_g$=217° C.), 8015, 9011 ($T_g$=217° C.), 9075, and 9076, all commercially available from Sabic Innovative Plastics.

Examples of polyimide polymers that can be selected as supporting substrates for the disclosed members include P84® polyimide available from HP Polymer Inc., Lewisville, Tex.

The substrate can be of a number of different thicknesses, such as from about 25 to about 250 microns, from about 50 to about 200 microns, or from about 75 to about 150 microns, and where the check film total thickness is, for example, from about 1 to about 10 mils, from about 1 to about 8 mils, from about 1 to about 5 mils, from about 2 to about 4 mils, and more specifically, about 3.8 mils to about 4 mils, which thicknesses can be measured by known means such as a Permascope.

Alkoxyalkylated Polyamides

Alkoxyalkylated polyamides, such as N-alkoxyalkylated polyamides, include those polyamides generated by the alkoxyalkylation of polyamides such as Nylon 6, Nylon 11, Nylon 12, Nylon 6,6, Nylon 6,10, Nylon copolymers, mixtures thereof, and the like. Thus, for example, Nylon 6 is methoxymethylated in accordance with the following reaction scheme where I, m and n represent the number of repeating segments, and more specifically, where I is from about 50 to about 500, from about 100 to about 300, or from about 175 to about 250; m is from about 25 to about 450, from about 100 to about 300, from about 125 to about 195, or from about 50 to about 270; and n is from about 5 to about 250, from about 50 to about 175, or from about 10 to about 150, and where I is equal to the sum of m plus n.

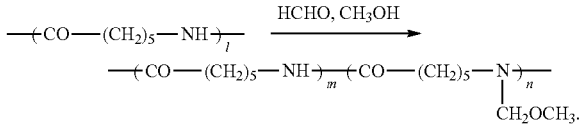

Examples of N-methoxymethylated polyamide Nylon 6 examples include FINE RESIN® FR101 (about 30 percent methoxymethylation rate, weight average molecular weight of about 20,000, available from Namariichi Company, Limited), TORESIN® F30K (about 30 percent methoxymethylation rate, weight average molecular weight of about 25,000, available from Nagase ChemTex Corporation), TORESIN® EF30T (about 30 percent methoxymethylation rate, weight average molecular weight of about 60,000, available from Nagase ChemTex Corporation), a number of commercially suitable methoxymethylated polyamides, and generally various known alkoxyalkylated polyamides where alkoxy includes those groups with, for example, from about 1 to about 20 carbon atoms, from about 1 to about 18 carbon atoms, from about 1 to about 12 carbon atoms, from about 1 to about 10 carbon atoms, from about 1 to about 3 carbon atoms, and from about 1 to about 2 carbon atoms, and alkyl includes those groups with, for example, from about 1 to about 25 carbon atoms, from about 1 to about 18 carbon atoms, from about 1 to about 12 carbon atoms, from about 1 to about 6 carbon atoms, and from about 1 to about 2 carbon atoms.

Examples of alkoxyalkylated polyamides, in addition to the disclosed N-ethoxymethylated Nylon 6, that may be selected are N-methoxymethylated Nylon 11; N-methoxymethylated Nylon 12; N-methoxymethylated Nylon 6,6; N-methoxymethylated Nylon 6,10; and N-methoxymethylated Nylon copolymers copolymers comprised of at least two of the disclosed Nylons; N-methoxybutylated Nylon 6; N-methoxybutylated Nylon 11; N-methoxybutylated Nylon 12; N-methoxybutylated Nylon 6,6; N-methoxybutylated Nylon 6,10; N-methoxybutylated Nylon copolymers comprised of at least two of the disclosed Nylons; the corresponding ethoxy, propoxy, butoxy, pentoxy and ethyl, methyl, propyl, butyl, and pentyl derivatives thereof; and combinations, and mixtures thereof.

In embodiments of the present disclosure the transfer assist member crosslinked alkoxyalkylated polyamide is selected from the group consisting of a ethoxymethylated polyamide, a propoxymethylated polyamide, a butoxymethylated polyamide, an ethoxyethylated polyamide, an ethoxypropylated polyamide, and an ethoxybutylated polyamide.

Optional Second Resins

Examples of optional second resins or co-resins present in the crosslinked layer mixture in amounts of, for example, from about 1 to about 20 weight percent, from about 1 to about 15 weight percent, from about 1 to about 10 weight percent, and more specifically, from about 7 to about 9 weight percent, include polyvinyl butyrals (PVB), such as commercially available S-LEC® BL-1 (weight average molecular weight of about 19,000, hydroxyl content of about 36 mol percent), BM-1 (weight average molecular weight of about 40,000, hydroxyl content of about 34 mol percent), BX-1 (weight average molecular weight of about 100,000, hydroxyl content of about 33 mol percent), and KS-1 (weight average molecular weight of about 27,000, hydroxyl content of about 25 mol percent), all available from SEKISUI Chemical Company, Limited; polyvinyl formals, and a partially acetylated polyvinyl butyrals, where the butyral moieties are modified in part with formal, acetoacetal, or the like; mixtures thereof, and the like.

Optional Catalysts

A number of catalysts can be selected for the disclosed mixture, and which catalysts can function to assist in and accelerate the crosslinking of the disclosed mixture.

Specific examples of acid catalysts selected include p-toluene sulfonic acid (p-TSA), dinonyl naphthalene disulfonic acid (DNNDSA), dinonyl naphthalene sulfonic acid (DNNSA), dodecylbenzenesulfonic acid (DDBSA), alkyl acid phosphates, phenyl acid phosphates, oxalic acid, maleic acid, carbolic acid, ascorbic acid, malonic acid, succinic acid, tartaric acid, citric acid, methane sulfonic acid, and mixtures thereof, and more specifically, p-toluene sulfonic acid.

Commercially available acid catalyst examples selected include p-toluene sulfonic acid (p-TSA) types and their blocked forms such as CYCAT® 4040, 4045, available from Allnex Belgium SA/NV, and K-CURE® 1040, 1040W, NACURE® XP-357, (a blocked p-toluenesulfonic acid in methanol, pH of 2-4, dissociation temperature of about 65° C.), 2107, 2500, 2501, 2522, 2530, 2547, 2558, all available from King Industries, Inc., Science Road, CT; dinonyl naphthalene disulfonic acid (DNNDSA) types and their blocked forms such as CYCAT® 500, all available from Allnex Belgium SA/NV; NACURE® 155, X49-110, 3525, 3327, 3483, all available from King Industries, Inc., Science Road, CT; dinonyl naphthalene sulfonic acid (DNNSA) types and their blocked forms such as NACURE® 1051, 1323, 1419, 1557, 1953, all available from King Industries, Inc., Science Road, CT; dodecylbenzenesulfonic acid (DDBSA) types and their blocked forms such as CYCAT® 600, available from Allnex Belgium SA/NV, and NACURE® 5076, 5225, 5414, 5528, 5925, all available from King Industries, Inc., Science Road, CT; acid phosphate types and their blocked forms such as CYCAT® 296-9, available from Allnex Belgium SA/NV, and NACURE® 4054, XC-C207, 4167, XP-297, 4575, all available from King Industries, Inc., Science Road, CT.

The amount of catalyst used is, for example, from about 0.01 to about 10 weight percent, from about 0.01 to about 5 weight percent, from about 0.1 to about 8 weight percent, from about 1 to about 5 weight percent, or from about 1 to about 3 weight percent based on the solids present. The primary purposes of the catalysts are to assist with curing and in the crosslinking of the disclosed mixtures. More specifically, the disclosed crosslinking reactions can be accelerated in the presence of a catalyst.

Subsequent to curing in the presence of a catalyst, which curing can be accomplished quickly, such as for example, from about 5 to about 20 minutes, from about 10 to about 15 minutes, and more specifically, about 10 minutes, of the disclosed mixture there results a crosslinked product, and where the curing can be accomplished by heating at temperatures equal to or exceeding about 80° C. for extended time periods. More specifically, the curing of the disclosed alkoxylated polyamide resin or the disclosed alkoxyalkylated polyamide resin mixture, in the absence of a catalyst or the presence of a catalyst, can be accomplished at various suitable temperatures, such as for example, from about 80° C. to about 220° C., from about 100° C. to about 180° C., and from about 125° C. to about 140° C. for a period of, for example, from about 1 to about 40 minutes, from about 3 to about 30 minutes, from about 5 to about 20 minutes, from about 10 to about 15 minutes, and yet more specifically, wherein the curing or drying time is from about 5 to about 10 minutes. There results, for example, a crosslinked product of the alkoxyalkylated polyamides, a second resin, a conductive component, a catalyst, and other optional components illustrated herein, and where the crosslinked value is, for example, as illustrated herein, such as from about 40 to about 100 percent, from about 50 to about 95 percent, from about 75 to about 100 percent, from about 80 to about 100 percent, from about 80 to about 98 percent, or from about 80 to about 95 percent, and which crosslinking percentage was determined by Fourier Transform Infrared Spectroscopy (FTIR).

The crosslinked alkoxyalkylated polyamide or the crosslinked alkoxyalkylated polyamide containing mixture are present in the disclosed transfer assist members in a number of differing effective amounts, such as for example, a total of 100 percent in those situations when no conductive components and no other optional components, such as plasticizers and silicas, are present, from about 90 to about 99 weight percent, from about 80 to about 90 weight percent, from about 65 weight percent to about 99 weight percent, from about 60 to about 90 weight percent, from about 70 to about 90 weight percent, from about 65 to about 75 weight percent, or from about 50 to about 60 weight percent providing the total percent of components present is about 100 percent, and wherein the weight percent is based on the total solids, such as the solids of the alkoxyalkylated polyamides, the second resin when present, the conductive component or filler when present, the plasticizer when present, leveling agents when present, catalyst when present, silica when present, and the fluoropolymers when present.

The crosslinked containing mixture in, for example, the configuration of a layer, can be of a number of differing thicknesses depending, for example, on the thicknesses of the other layers that may be present and the components present in each layer, which crosslinked layer thicknesses are, for example, from about 0.1 to about 50 microns, from about 1 to about 40 microns, or from about 5 to about 20 microns.

Optional Conductive Components

The crosslinked mixture can further comprise optional conductive components, such as known carbon forms like carbon black, graphite, carbon nanotubes, fullerene, graphene, and the like; metal oxides, mixed metal oxides; conducting polymers, such as polyaniline, polythiophene, polypyrrole, mixtures thereof, and the like.

Examples of carbon black conductive components that can be selected for incorporation into the illustrated herein crosslinked mixture include KETJENBLACK® carbon blacks available from AkzoNobel Functional Chemicals; special black 4 (B.E.T. surface area of about 180 $m^2/g$, DBP absorption of about 1.8 ml/g, primary particle diameter of about 25 nanometers) available from Evonik-Degussa; special black 5 (B.E.T. surface area of about 240 $m^2/g$, DBP absorption of about 1.41 ml/g, primary particle diameter of about 20 nanometers); color black FW1 (B.E.T. surface area of about 320 $m^2/g$, DBP absorption of about 2.89 ml/g, primary particle diameter of about 13 nanometers); color black FW2 (B.E.T. surface area of about 460 $m^2/g$, DBP absorption of about 4.82 ml/g, primary particle diameter of about 13 nanometers); color black FW200 (B.E.T. surface area of about 460 $m^2/g$, DBP absorption of about 4.6 ml/g, primary particle diameter of about 13 nanometers), all available from Evonik-Degussa; and VULCAN® carbon blacks, REGAL® carbon blacks, MONARCH® carbon blacks, EMPEROR® carbon blacks, and BLACK PEARLS® carbon blacks all available from Cabot Corporation. Specific examples of conductive carbon blacks are BLACK PEARLS® 1000 (B.E.T. surface area=343 $m^2/g$, DBP absorption=1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area=35 $m^2/g$, DBP absorption=1.22 ml/g), EMPEROR® E1200, EMPEROR® E1600, VULCAN® XC72 (B.E.T. surface area=254 $m^2/g$, DBP absorption=1.76 ml/g), VULCAN® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL® 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers); special carbon blacks available from Evonik Incorporated; and Channel carbon blacks available from Evonik-Degussa. Other known suitable carbon blacks not specifically disclosed herein may be selected as the filler or conductive component.

Examples of polyaniline conductive components that can be selected are PANIPOL™ F, commercially available from Panipol Oy, Finland, and known lignosulfonic acid grafted polyanilines. These polyanilines usually have a relatively small particle size diameter of, for example, from about 0.5 to about 5 microns, from about 1.1 to about 2.3 microns, or from about 1.5 to about 1.9 microns.

Metal oxide conductive components that can be selected include, for example, tin oxide, antimony doped tin oxide, indium oxide, indium tin oxide, zinc oxide, titanium oxides, mixtures thereof, and the like.

When present, the conductive component or conductive components can be selected in an amount of, for example, from about 1 to about 70 weight percent, from about 3 to about 40 weight percent, from about 4 to about 30 weight percent, from about 5 to about 20 weight percent, from about 10 to about 30 percent, from about 8 to about 25 weight percent, or from about 3 to about 10 weight percent of the total solids.

Optional Plasticizers

Optional plasticizers, which can be considered plasticizers that primarily increase the plasticity or fluidity of the disclosed mixtures include diethyl phthalate, dioctyl phthalate, diallyl phthalate, polypropylene glycol dibenzoate, di-2-ethyl hexyl phthalate, diisononyl phthalate, di-2-propyl heptyl phthalate, diisodecyl phthalate, di-2-ethyl hexyl terephthalate, and other known suitable plasticizers. The plasticizers can be utilized in various effective amounts, such as for example, from about 0.1 to about 30 weight percent, from about 1 to about 20 weight percent, or from about 3 to about 15 weight percent based on the solids present.

Optional Silicas

Optional silica examples selected for the disclosed mixtures, and which can contribute to the wear resistant properties of the members and blades illustrated herein include silica, fumed silicas, surface treated silicas, other known silicas, such as AEROSIL R972®, mixtures thereof, and the like. The silicas are selected in various effective amounts, such as for example, from about 0.1 to about 20 weight percent, from about 1 to about 15 weight percent, and from about 2 to about 10 weight percent based on the solids present.

Optional Fluoropolymers

Optional fluoropolymers and particles thereof that can be selected for the disclosed transfer assist member crosslinked mixture, and that can contribute to the wear resistant properties of the members and blades illustrated herein include tetrafluoroethylene polymers (PTFE), trifluorochloroethylene polymers, hexafluoropropylene polymers, vinyl fluoride polymers, vinylidene fluoride polymers, difluorodichloroethylene polymers, or copolymers thereof. The fluoropolymers are selected in various effective amounts, such as for example, from about 0.1 to about 20 weight percent, from about 1 to about 15 weight percent, and from about 2 to about 10 weight percent based on the solids present.

Optional Leveling Agents

Optional leveling agent examples, which can contribute to the smoothness characteristics, such as enabling smooth coating surfaces with minimal or no blemishes or protrusions, of the members and blades illustrated herein include silicones, such as epoxy-modified silicones (dual-end type), X-22-163C with a reported functional group equivalent weight of 2,700 g/mol, available from Shin-Etsu Silicones; polysiloxane polymers or the fluoropolymers illustrated herein, and mixtures thereof.

The optional polysiloxane polymers include, for example, a polyester modified polydimethylsiloxane with the trade name of BYK® 310 (about 25 weight percent in xylene) and BYK® 370 (about 25 weight percent in xylene/alkylbenzenes/cyclohexanone/monophenylglycol=75/11/7/7); a polyether modified polydimethylsiloxane with the trade name of BYK® 333, BYK® 330 (about 51 weight percent in methoxypropylacetate) and BYK® 344 (about 52.3 weight percent in xylene/isobutanol=80/20), BYK®-SILCLEAN 3710 and 3720 (about 25 weight percent in methoxypropanol); a polyacrylate modified polydimethylsiloxane with the trade name of BYK®-SILCLEAN 3700 (about 25 weight percent in methoxypropylacetate); or a polyester polyether modified polydimethylsiloxane with the trade name of BYK® 375 (about 25 weight percent in di-propylene glycol monomethyl ether), all commercially available from BYK Chemical of Wallingford, Conn. The leveling agents are selected in various effective amounts, such as for example, from about 0.01 to about 5 weight percent, from about 0.1 to about 3 weight percent, and from about 0.2 to about 1 weight percent based on the solids present.

Optional Adhesives

Optional adhesive layers designated, for example, as 6*pa*, 7*pa*, 8*pa*, and 9*pa*, in FIG. 3 can be included between each of the member layers, partially included at the edges between each of the member layers, or on the vertical sides between the substrate side of layer 1*pa* and layer 2*pa*, layers 2*pa* and 3*pa*, layers 3*pa*, and 4*pa*, and on the horizontal sides between layer 4*pa* and the overcoat top layer 5*pa*. The horizontal sides of layers 1*pa*, 2*pa*, 3*pa* and 4*pa* are usually not bonded together.

A number of known adhesives can be selected for each adhesive layer, inclusive of suitable polyesters, such as a 3M™ Double Coated Tape 444, which is, for example, about 3.9 mils thick in one form; a 300 high tack acrylic adhesive with, for example, a 0.5 mil thick polyester carrier; white densified Kraft paper liner (55 lbs), mixtures thereof, and the like.

The adhesive layer thicknesses, which can vary, are, for example, from about 1 to about 50 millimeters, from about 10 to about 40 millimeters, or from about 15 to about 25 millimeters.

Optional Top Wear Resistant Layer

The transfer assist member top or wear resistant layer, which can be bonded, is designated, for example, by the numeral 5*pa*, illustrated in FIG. 3, and this wear resistant layer can be comprised of various suitable known and commercially available materials, such as polyolefins like ultra-high molecular weight polyethylenes (UHMW), a wear-resistant plastic with a low coefficient of friction, excellent impact strength, and possessing chemical and moisture resistance. UHMW wear resistant layer materials comprise long chains of polyethylene of the formula/structure illustrated below, which usually aligns in the same direction, and which can derive its protective characteristics mostly from the length of each individual molecule (chain)

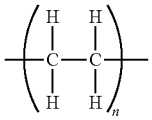

wherein n represents the number of repeating segments of, for example, from about 100,000 to about 300,000, from about 150,000 to about 225,000, or from about 200,000 to about 275,000.

The thickness of the disclosed top wear resistant layer can vary depending, for example, on the thicknesses of the other layers that may be present and the components in each layer. Thus, for example, the thicknesses of the wear resistant layer can vary from about 1 to about 20 mils, from about 1 mil to about 15 mils, from about 2 to about 10 mils, or from about 1 mil to about 5 mils as determined by known means such as a Permascope.

Optional Solvents

Examples of solvents selected for formation of the members illustrated herein, especially for the formation of the dispersions of the disclosed mixtures, which solvents can be selected in an amount of, for example, from about 60 to about 95 weight percent, or from about 70 to about 90 weight percent of the total mixture components weight include, for example, alcohols, such as methanol, ethanol, propanol, butanol, pentanol, oleyl alcohol, benzyl alcohol, lauryl alcohol and alcohol ethers of, for example, the alkyl ethers of ethylene glycol and other known alkyl alcohols, mixtures thereof, and the like. Diluents that can be mixed with the solvents in amounts of, for example, from about 1 to about 25 weight percent, and from 1 to about 10 weight percent based on the weight of the solvent and the diluent are known diluents like aromatic hydrocarbons, ethyl acetate, acetone, cyclohexanone and acetanilide.

Also included within the scope of the present disclosure are methods of imaging and printing with the transfer assist members and check films illustrated herein. These methods generally involve the formation of an electrostatic latent image on an imaging photoconductive member, followed by developing the image with a toner composition comprised, for example, of a thermoplastic resin, a colorant, such as a pigment, dye, or mixtures thereof, a charge additive, internal additives like waxes, and surface additives, such as for example, silica, coated silicas, aminosilanes, and the like, reference U.S. Pat. Nos. 4,560,635 and 4,338,390, the disclosures of each of these patents being totally incorporated herein by reference; subsequently transferring with the disclosed transfer assist member the toner image to a suitable image receiving substrate, and permanently affixing the image thereto. In those environments wherein a printing mode is selected, the imaging method involves the same operation with the exception that exposure can be accomplished with a laser device or image bar. More specifically, the transfer assist members disclosed herein can be selected for the Xerox Corporation iGEN® machines, inclusive of the iGenF®, that generate with some versions over 125 copies per minute. Processes of imaging, especially xerographic imaging and printing, including digital and/or color printing are thus encompassed by the present disclosure and where the disclosed transfer assist member (TAB), such as a member in the configuration of a blade, sweeps the backside of the image support substrate with a constant sufficient force at the entrance to the toner developed transfer region. In embodiments, the top wear layer of the TAB contacts the backside of the image support substrate directly, and where the disclosed check film does not contact the image support layer.

Specific embodiments will now be described in detail. These examples are intended to be illustrative, and not limited to the materials, conditions, or process parameters set forth in these embodiments. All parts are percentages by solid weight unless otherwise indicated. The disclosed molecular weights, such as $M_w$ (weight average) and $M_n$ (number average), were provided by the entities disclosed herein and can, it is believed, be measured by a number of known methods, and more specifically, by Gel Permeation Chromatography (GPC).

Example I

There was prepared a transfer assist blade check film as follows:

Preparation of a Crosslinked Coating Dispersion

There was prepared a dispersion by mixing FINE RESIN® FR101 (an N-methoxymethylated Nylon 6 polyamide with about 30 percent methoxymethylation rate or value, and a weight average molecular weight of about 20,000, which resin is available from Namariichi Company, Limited), a co-resin or second resin of S-LEC® BL-1 (a polyvinyl butyral with a weight average molecular weight of about 19,000, and a hydroxyl content of about 36 mole percent, and which second resin is available from SEKISUI Chemical Company, Limited), the acid catalyst NACURE® XP-357 (a blocked p-toluenesulfonic acid in methanol, pH of 2-4, dissociation temperature of about 65° C., available from King Industries), and a leveling agent of BYK-SIL-CLEAN® 3700 (a modified polydimethylsiloxane available from BYK of Connecticut) in methanol/1-butanol, 75/25 (about 10 weight percent solids) via agitation to obtain a polymeric base solution.

EMPEROR® E1200, a carbon black available from Cabot Corporation, or Cabot Company, was then added to the above prepared containing polymeric base solution. The resulting mixture was ball milled with 2 millimeter diameter stainless steel shots at 200 rpm for 20 hours. Thereafter, the resulting dispersion, FINE RESIN® FR101/S-LEC® BL-1/

EMPEROR® E1200/NACURE® XP-357/BYK-SIL-CLEAN® 3700, in a weight ratio of 80/8/10/1/1 in methanol/1-butanol 75/25, about 10 weight percent solids, was then separated from the steel shots by filtration through a 20 micron Nylon cloth filter to obtain the final coating dispersion.

Subsequently, the above prepared resulting final coating dispersion was deposited and coated on a 3 mil thick PET supporting substrate via a production extrusion coater, followed by curing the coating at 140° C. for 10 minutes to obtain a flat oriented check film comprised of the above prepared 10 micron thick crosslinked mixture layer, 80/8/10/1/1, present on the 3 thick mil PET substrate, and where the crosslinking value was about 90 percent as determined by Fourier Transform Infrared Spectroscopy (FTIR).

The resistance of the above prepared partially conductive crosslinked overcoat mixture check film member, where the crosslinked mixture was free of formaldehyde and free of solvents like methylene chloride, was measured to be about $5.1\times10^8$ ohm using a Trek Model 152-1 Resistance Meter, and was very uniform across the entire 2.5 inch×17 inch (the dimension of the real blade petal assembly) sample strip. Furthermore, the adhesion between the disclosed crosslinked containing mixture layer and the PET substrate was excellent, did not peel when subjected to adhesion testing by attempting to hand separate the substrate and the crosslinked layer mixture, and possessed excellent wear resistant characteristics and significant hand rubbing resistance where there was essentially no adverse developed image defects visually noticed. More specifically, for a rub/wear test after 1 million rub/wear cycles in the xerographic machine iGenF® available from Xerox Corporation, the above prepared crosslinked check film illustrated substantially no wear spots.

Preparation of the Petal Assembly (Blade Material Comprising Five Layers for the Transfer Assist Member)

The above prepared disclosed check film, 10 microns thick, on the 3 mil thick PET, polyethylene terephthalate polymer layer, and three separate 5 mil thick MYLAR® PET films were cut into 4 millimeter by 38 millimeter strips, and the strips were aligned in the sequence of MYLAR® PET film, MYLAR® PET film, and MYLAR® PET film, with the disclosed check film PET substrate facing the MYLAR® PET film. Each adjacent pair of the aforementioned layers was bonded together using 3M™ Double Coated Tape 444 in between from the edges of the long sides to about 2.5 millimeters inside. The partially bonded layers were folded rendering the 2.5 millimeter wide bonded layers into a vertical position and the 1.5 millimeter wide unbounded layers into a horizontal position. The horizontal sections of the above layers were then cut into about 40 smaller segments with rectangular shapes.

Thereafter, there was applied to the above prepared member a wear resistant layer of a UHMW polyethylene, obtained from E.I. DuPont and believed to be of the following formula/structure

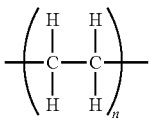

wherein n represents the number of repeating segments of from about 150,000 to about 225,000, and which wear resistant layer was bonded to the horizontal section of the top MYLAR® PET film. The horizontal sections of the above layers can then be cut into about 40 smaller segments with rectangular shapes.

Preparation of the Transfer Assist Member Assembly

The aluminum extruded element, such as element 1 of FIG. 1, was then attached to the above transfer assist member petal assembly, and then attached to the transfer assist member stainless steel clamp assembly, and the transfer assist member aluminum rivet illustrated herein to form the transfer assist member.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A transfer assist member comprising a plurality of layers, one of said layers being a check film layer comprised of a crosslinked alkoxyalkylated polyamide.

2. A transfer assist member in accordance with claim 1 wherein crosslinking of the alkoxyalkylated polyamide results from curing the alkoxyalkylated polyamide in the presence of a catalyst, and wherein a crosslinked value for the alkoxyalkoxylated polyamide is from about 40 to about 100 percent.

3. A transfer assist member in accordance with claim 1 wherein said check film layer further includes a conductive component of carbon black and a second polymer.

4. A transfer assist member in accordance with claim 1 wherein said crosslinked alkoxyalkylated layer further includes a conductive component, a polyvinylbutyral polymer, a catalyst, a silicone leveling agent, or a fluoropolymer leveling agent, a plasticizer, a silica, a fluoropolymer, or mixtures thereof.

5. A transfer assist member in accordance with claim 1 further including in contact with said check film layer a polymer supporting layer comprised of a polyester, a polyamide, a polyetherimide, a polyamideimide, a polyimide, a polyphenyl sulfide, a polyether ether ketone, a polysulfone, a polycarbonate, a polyvinyl halide, a polyolefin, a polyethylene terephthalate, or mixtures thereof.

6. A transfer assist member in accordance with claim 5 wherein said polymer supporting layer is comprised of a polyethylene terephthalate, and wherein said alkoxyalkylated polyamide is a N-alkoxyalkylated polyamide.

7. A transfer assist member in accordance with claim 1 wherein said crosslinked alkoxyalkylated layer further includes a conductive component of carbon black, graphite, metal oxide, polyaniline, polythiophene, polypyrrole, or mixtures thereof; a polyvinylbutyral polymer; a silica; a polysiloxane; a polytetrafluoroethylene; a catalyst, and an optional plasticizer, and which member further includes a polymer support layer comprised of a polyethylene terephthalate or a polyethylene naphthalate, and wherein said alkoxyalkylated polyamide is a N-alkoxyalkylated polyamide.

8. A transfer assist member in accordance with claim 7 wherein said plasticizer is present and is selected from the group consisting of at least one of diethyl phthalate, dioctyl phthalate, diallyl phthalate, polypropylene glycol dibenzoate, di-2-ethyl hexyl phthalate, diisononyl phthalate, di-2-propyl heptyl phthalate, diisodecyl phthalate, and di-2-ethyl hexyl terephthalate.

9. A transfer assist member in accordance with claim 1 wherein the plurality of layers is from 2 to 10 layers.

10. A transfer assist member in accordance with claim 1 wherein said plurality of layers is comprised of at least three separate polymer layers comprising a bottom polymer layer, a middle polymer layer, and a top polymer layer, and wherein said bottom polymer layer is in contact with said check film layer.

11. A transfer assist member in accordance with claim 1 wherein the alkoxy portion of said alkoxyalkylated polyamide contains from about 1 to about 18 carbon atoms, and the alkyl portion of said alkoxyalkylated polyamide contains from about 1 to about 12 carbon atoms.

12. A transfer assist member in accordance with claim 1 wherein the alkoxy portion of said alkoxyalkylated polyamide contains about 1 to about 10 carbon atoms, and wherein the alkyl portion of said alkoxyalkylated polyamide contains from about 1 to about 6 carbon atoms.

13. A transfer assist member in accordance with claim 1 wherein said alkoxyalkylated polyamide is present in an amount of about 70 to about 90 weight percent of the crosslinked solids, and wherein said alkoxyalkylated polyamide is generated from the alkoxyalkylation of a Nylon selected from the group consisting of Nylon 6, Nylon 11, Nylon 12, Nylon 6,6, Nylon 6,10, and Nylon copolymers.

14. A transfer assist member in accordance with claim 1 wherein said alkoxyalkylated polyamide is a methoxymethylated polyamide.

15. A transfer assist member in accordance with claim 1 wherein said alkoxyalkylated polyamide is selected from the group consisting of an ethoxymethylated polyamide, a propoxymethylated polyamide, a butoxymethylated polyamide, an ethoxyethylated polyamide, an ethoxypropylated polyamide, and an ethoxybutylated polyamide.

16. A transfer assist member in accordance with claim 1 further comprising a wear resistant layer of a polyethylene as represented by the following formula/structure

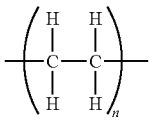

wherein n represents the number of repeating segments.

17. A transfer assist member in accordance with claim 2 wherein said catalyst is selected from the group consisting of toluene sulfonic acid, dinonyl naphthalene disulfonic acid (DNNDSA), dinonyl naphthalene sulfonic acid (DNNSA), dodecylbenzenesulfonic acid (DDBSA), alkyl acid phosphate, phenyl acid phosphate, oxalic acid, maleic acid, carbolic acid, ascorbic acid, malonic acid, succinic acid, tartaric acid, citric acid, methane sulfonic acid, and mixtures thereof, and wherein said polyamide is selected from the group consisting of Nylon 6, Nylon 11, Nylon 12, Nylon 6,6, and Nylon 6,10.

18. A transfer assist member in accordance with claim 2 wherein said catalyst is a para-toluene sulfonic acid.

19. A composite toner transfer assist blade comprising a plurality of bonded layers inclusive of a bonded check film layer comprised of a crosslinked layer mixture of alkoxyalkylated polyamide contained on a polymer layer substrate of a polyalkylene terephthalate, a polyester, or mixtures thereof; and further including in said mixture at least one conductive component, at least one catalyst, at least one polysiloxane polymer, and a polyvinylbutyral.

20. A transfer assist blade in accordance with claim 19 wherein said plurality of layers comprises three polyester layers, and wherein said plurality of layers is in contact with said polymer layer substrate on which its opposite side is situated said check film layer.

21. A transfer assist blade in accordance with claim 19 with a resistance of from about $1\times10^7$ to about $1\times10^9$ ohm, and wherein said crosslinked mixture is present in an amount of from about 60 to about 90 weight percent based on the total solids, said crosslinked layer mixture is of a thickness of from about 0.1 to about 50 microns, said conductive component is present in an amount of from about 5 to about 20 weight percent based on the total solids, said catalyst is present in an amount of from about 0.01 to about 5 weight percent based on the total solids, and said polysiloxane polymer is present in an amount of from about 0.01 to about 5 weight percent based on the total solids.

22. A transfer assist blade in accordance with claim 19 further comprising a wear resistant layer of a polyethylene as represented by the following formula/structure

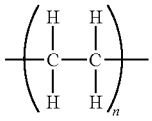

wherein n for said wear resistant layer represents the number of repeating segments of from about 100,000 to about 300,000.

23. A xerographic process for providing substantially uniform contact between a copy substrate and a toner developed image located on an imaging member, comprising providing said contact by using a toner transfer flexible assist blade that comprises a plurality of adhesive bonded layers, wherein said flexible transfer assist blade is adapted to move from a non-operative position spaced from the imaging member to an operative position in contact with the copy substrate on the imaging member, applying pressure against the copy substrate in a direction toward the imaging member, and wherein said plurality of layers comprises at least one check film layer comprised of a mixture of a crosslinked alkoxyalkylated polyamide, a conductive component, an acid catalyst, an optional leveling agent, and a polyvinyl butyral resin, and wherein said crosslinked value is from about 75 to about 100 percent, and which check film layer is present in a polymer substrate of a polyalkylene terephthalate, a polyester, or mixtures thereof.

* * * * *